US008287246B2

(12) United States Patent
Plitt et al.

(10) Patent No.: US 8,287,246 B2
(45) Date of Patent: Oct. 16, 2012

(54) SYSTEMS AND METHODS FOR AUTOMATIC FORWARD PHASING DETERMINATION IN A DOWNHOLE PUMP SYSTEM

(75) Inventors: Sheldon Plitt, Leduc (CA); Jerald R. Rider, Catoosa, OK (US); Dick L. Knox, Claremore, OK (US); William Carter, Jr., Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 475 days.

(21) Appl. No.: 12/537,154

(22) Filed: Aug. 6, 2009

(65) Prior Publication Data

US 2011/0033314 A1 Feb. 10, 2011

(51) Int. Cl.
*F04B 49/06* (2006.01)

(52) U.S. Cl. ..... 417/44.11; 318/3; 318/9; 318/10

(58) Field of Classification Search ..... 417/44.1, 417/423.3, 423.31; 318/432, 434, 280, 286, 318/289, 293
See application file for complete search history.

(56) References Cited

U.S. PATENT DOCUMENTS 3,976,919 A * 8/1976 Vandevier et al. ..... 361/96
4,000,446 A 12/1976 Vandevier
4,021,700 A 5/1977 Ellis-Anwyl
4,410,845 A * 10/1983 Lockyear ..... 318/459
4,451,209 A 5/1984 Phillips
4,490,094 A * 12/1984 Gibbs ..... 417/42
4,667,264 A * 5/1987 Yamazaki et al. ..... 361/77
5,198,734 A 3/1993 Johnson
5,252,031 A * 10/1993 Gibbs ..... 417/53
5,973,465 A * 10/1999 Rayner ..... 318/459
6,254,353 B1 7/2001 Polo
2008/0131294 A1 6/2008 Koehl
2008/0131295 A1 6/2008 Koehl
2008/0247880 A1* 10/2008 Leuthen et al. ..... 417/44.11
2011/0050145 A1* 3/2011 Plitt et al. ..... 318/490
2011/0051297 A1* 3/2011 Knox et al. ..... 361/23

OTHER PUBLICATIONS

A. Comeau & Assoc. Ltd.,K095 AMC Operators Manual 1.3E, p. 20.

* cited by examiner

*Primary Examiner* — Devon Kramer
*Assistant Examiner* — Christopher Maxey
(74) *Attorney, Agent, or Firm* — Law Offices of Mark L. Berrier

(57) ABSTRACT

Systems and methods for controlling an electrical drive such as is used with electric submersible pumps used in downhole oil production, wherein the drive automatically determines the proper phasing to drive the pump motor in a forward direction. In one embodiment, a method includes generating a drive signal having an initial phasing and driving the pump to establish a column of fluid in the borehole. The drive signal is then discontinued, allowing the column of fluid to fall through the pump and cause the pump to backspin and generate a signal having phasing corresponding to the reverse rotational direction. The forward phasing is then determined to be the opposite of the phasing corresponding to the reverse rotational direction. The pump can be restarted in the forward direction, or an operator can be notified of the proper phasing to produce forward rotation of the pump.

14 Claims, 6 Drawing Sheets

SYSTEMS AND METHODS FOR AUTOMATIC FORWARD PHASING DETERMINATION IN A DOWNHOLE PUMP SYSTEM

BACKGROUND

1. Field of the Invention

The invention relates generally to electrical control systems, and more particularly to systems and methods for controlling an electrical drive such as a variable speed drive of the type used in connection with electric submersible pumps used in downhole oil production, wherein the drive automatically determines the proper phasing to drive the pump motor in a forward direction and can then notify the operator or start the pump in the forward direction 2. Related Art Crude oil is typically produced by drilling wells into oil reservoirs and then pumping the oil out of the reservoirs through the wells. Often, the oil is pumped out of the wells using electric submersible pumps. Electrical power is provided to electrical drive systems at the surface of the wells, and these drive systems provide electrical power to the pumps to allow them to pump fluid from the wells.

Electric submersible pumps can typically be operated in either "forward" or "reverse" directions. The forward direction, as that term is used herein, is the direction of rotation in which the pump is designed to pump fluid. This fluid is pumped up through the wellbore and out of the well. The direction of rotation opposite the forward direction is referred to herein as the reverse direction.

Many electric submersible pumps will still pump fluid out of the well when operating in the reverse direction, but they normally are not as efficient when pumping in the reverse direction as in the forward direction.

An electric submersible pump typically operates on three-phase power. The electrical drive system at the surface of the well normally receives AC power and converts this power to a three-phase drive signal that is conveyed to the pump motor to drive the motor, which in turn drives the pump to produce fluid from the well. When a pump is installed, the installation is performed according to procedures that are intended to be followed to ensure that the pump is properly connected to the electrical drive system. With the various junction boxes and cable splices between the drive and the pump, however, it is not unusual for mistakes to be made, resulting in electrical connections between the electrical drive system and pump motor that are incorrect. In particular, the cabling that carries the three-phase electrical signal from the electrical drive system to the pump motor may be connected with two or more of the wires switched. The misconnection of the wires in this cabling may also occur when maintenance is performed on the electrical drive system or the cabling.

Because the phasing of a three-phase electrical signal is reversed when any two of the three wires are switched, misconnection of these wires can result in the pump motor being driven in a direction which is opposite the intended direction. In other words, when the electrical drive system produces a drive signal with phasing that is intended to drive the pump in the forward direction, it actually drives the pump in the reverse direction. As noted above, while the pump may produce fluid from the well even in the reverse direction, this is not as efficient and does not produce as much fluid as driving the pump in the forward direction. Also, when the pump is run in the reverse direction, the resulting torque tends to loosen the connection between the pump and the tube string and the connections between individual pipe sections in the tube string.

It is assumed for the purposes of this disclosure that the phase differences between the three phases of the drive unit's output signals are substantially equal. When any two of the phases are switched, the effect is to reverse the order of the phases. For instance, if the phases on lines A, B and C occur in the order A-B-C, switching the signals on any two of the lines will result in the phase order C-B-A. It is therefore assumed that any output signal generated by the drive unit will have one of these two orders, or phasings.

When an operator is starting a downhole pump, but does not know the proper phasing for driving the pump in a forward direction, the operator must typically make an initial guess as to the proper phasing. The pump is then started using this phasing and is run for some amount of time which is sufficient to determine the production (the amount of fluid which is produced) using this phasing. Usually, the pump is operated until fluid is produced at the surface (the surface of the geological structure in which the well has been drilled). After the level of production has been measured with the pump running in this direction, the pump is stopped so that it can be run in the opposite direction. Normally, the column of fluid in the wellbore must be allowed to drain completely before the pump can be restarted in the opposite direction, which may require as much as several hours. The pump cannot normally be started until the column of fluid has drained from the well because the pump motor does not have sufficient torque to overcome the flow of the falling fluid, and trying to start the pump motor could cause it to be damaged. Once the fluid has drained from the wellbore, the operator runs the pump using phasing which is opposite the initial guess so that the pump is driven in the opposite direction. The pump is again operated for a period which is sufficient to measure the resulting production from the well. The pump may have to be run several times in each direction. The measurements corresponding to the different directions of rotation of the pump are then compared, and the direction which results in the higher production is assumed to be the forward direction. The pump is then restarted in the forward direction.

Although this procedure allows the well operator to determine the proper phasing to drive the pump in a forward rotational direction, it is not without its own problems. For instance, it is typically a very time-consuming process because it is necessary to operate the pump in both directions for long enough to produce fluid from the well in each direction. Additionally, it is necessary to wait for the column of fluid that has been established in the wellbore to drain back through the pump before the pump can be restarted in the opposite direction. All of this downtime during the procedure amounts to lost production from the well. This conventional procedure is also problematic because the steps of the procedure must be performed manually by the operator, which adds to the effective cost of the procedure and also presents the opportunity for mistakes to be made by the operator (e.g., mis-measurements of production amounts or mistakes in correcting the phasing).

It would therefore be desirable to provide systems and methods for automatically determining the proper phasing for driving a downhole pump in the proper (forward) direction and restarting the pump in the forward direction without the need for intervention by the well operator.

SUMMARY OF THE INVENTION

This disclosure is directed to systems and methods for controlling an electrical drive such as a variable speed drive of the type used in connection with electric submersible pumps used in downhole oil production, wherein the drive automatically determines the proper phasing to drive the pump motor in a forward direction and can then notify the operator or start the pump in the forward direction.

One embodiment of the invention comprises a method for automatically determining forward phasing for driving a downhole pump which is positioned in the borehole of a well. The method includes generating an initial drive signal that has an initial phasing and driving the pump for an initial period of time. This establishes a column of fluid in the borehole. The drive signal is then discontinued, allowing the column of fluid to fall through the pump and cause the pump to backspin (rotate in a reverse rotational direction) and generate a signal having phasing corresponding to the reverse rotational direction. The forward phasing is then determined to be the opposite of the phasing corresponding to the reverse rotational direction. Once the forward phasing is determined, the pump can be restarted in the forward direction, or an operator can be notified of the proper phasing to produce forward rotation of the pump. As an alternative to sensing the phasing generated by the backspinning pump, a rotation sensor coupled to the pump can be used to generate a signal that corresponds to the reverse rotation of the backspinning pump. The forward phasing can then be determined to be the phasing that produces opposite indication from the rotation sensor.

An alternative embodiment comprises a drive unit that is configured to automatically determine forward phasing for driving the downhole pump. The drive unit includes a control module that controls the functions of the drive unit and implements the method of the preceding embodiment. Another alternative embodiment includes not only the drive unit, but also the pump and the drive cable that couples the output of the drive unit to the motor of the pump. Still another embodiment includes the rotation sensor and interconnects which couple the output of the sensor to the drive unit. The drive unit may be configured to notify an operator of the proper phasing for forward rotation of the pump, or the drive unit can automatically restart the pump in the forward direction. The drive unit may also be operable in multiple modes, where in one mode the unit drives the pump without first determining the proper phasing for forward rotation, and in another mode, the drive unit first determines the proper phasing for forward rotation and then automatically restarts the pump in the forward direction.

Another embodiment comprises a method for automatically determining forward phasing for driving the downhole pump, wherein a check valve prevents the column of fluid in the borehole from falling through the pump and causing the pump to backspin. In this embodiment, a first drive signal having a first phasing is generated and the pump is driven for a first period of time. During this first period, one or more characteristics (e.g., torque or fluid flow rate) associated with the operation of the pump resulting from the first phasing are measured. The pump is then driven for a second period of time using a second drive signal having a second phasing which is opposite the first phasing. The one or more characteristics associated with the operation of the pump resulting from the second phasing are measured during this second period. Based on the first and second measurements, it is determined whether the first or the second phasing is associated with the forward rotational direction of the pump. For instance, whichever phasing corresponds to the higher torque or higher fluid flow rate is associated with the forward rotational direction of the pump. Once the forward phasing is determined, the pump can be restarted in the forward direction, or an operator can be notified of the proper phasing to produce forward rotation of the pump.

Another alternative embodiment comprises a drive unit that is configured to automatically determine forward phasing for driving the downhole pump as explained in the preceding method. System embodiments include the drive unit alone, as well as the pump system that includes the drive unit, pump and interconnecting cable. The drive unit may be configured to notify an operator of the proper forward phasing, or it can automatically restart the pump in the forward direction. The drive unit may be operable in multiple modes, where the proper phasing for forward rotation may or may not be determined before driving the pump, depending upon the mode of operation.

Numerous other embodiments are also possible.

BRIEF DESCRIPTION OF THE DRAWINGS

Other objects and advantages of the invention may become apparent upon reading the following detailed description and upon reference to the accompanying drawings.

Figure 1:
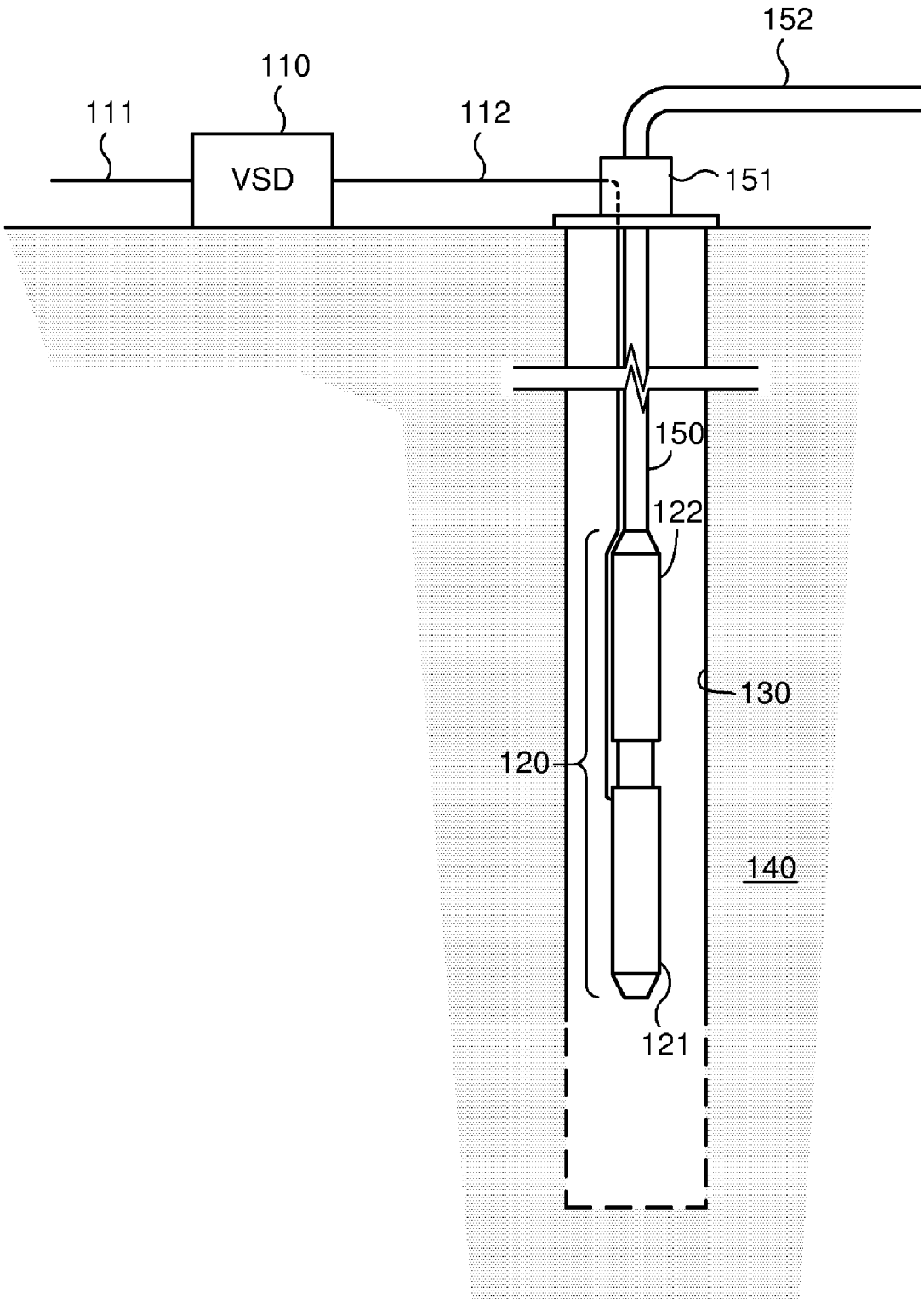
FIG. 1 is a diagram illustrating a pump system in which the present invention can be implemented.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention as defined by the appended claims.

DETAILED DESCRIPTION OF EXEMPLARY EMBODIMENTS

One or more embodiments of the invention are described below. It should be noted that these and any other embodiments described below are exemplary and are intended to be illustrative of the invention rather than limiting.

As described herein, various embodiments of the invention comprise systems and methods for controlling an electrical drive such as a variable speed drive of the type used in connection with electric submersible pumps used in downhole oil production, wherein the drive automatically determines the proper phasing to drive the pump motor in a forward direction and then starts the pump in the forward direction to produce fluid at the surface of a well.

Referring to FIG. 1, a diagram illustrating a typical pump system is shown. A wellbore 130 is drilled into an oil-bearing geological structure 140, and is cased. The casing within wellbore 130 is perforated at the lower end of the well to allow oil to flow from the formation into the well. Electric submersible pump 120 is coupled to the end of tubing string 150, and the pump and tubing string are lowered into the wellbore to position the pump in producing portion of the well (i.e., the perforated portion). A variable speed drive 110 which is positioned at the surface is coupled to pump 120 by drive output line 112, which runs down the wellbore along tubing string 150, which may be thousands of feet long.

Pump 120 includes an electric motor section 121 and a pump section 122. (Pump 120 may include various other components which will not be described in detail here because they are well known in the art and are not important to a discussion of the invention.) Motor section 121 is operated to drive pump section 122, which actually pumps the oil through the tubing string and out of the well. In this embodiment, motor section 121 uses an induction motor which is driven by variable speed drive 110. Variable speed drive 110 receives AC (alternating current) input power from an external source such as a generator (not shown in the figure) via input line 111. Drive 110 rectifies the AC input power and then produces output power that is suitable to drive motor section 121 of pump 120. This output power is provided to motor section 121 via drive output line 112.

Variable speed drive 110 generates a three-phase output signal that is used to drive motor section 121 of pump 120. The phasing of the output signal is intended to drive pump 120 in a forward direction. The phasing of the output signal can be reversed to drive the pump in the opposite direction as well, and is configured to operate the pump to automatically start the pump in the forward direction, as will be discussed in more detail below. The voltage of the drive output signal can be varied to adjust the speed of the pump motor. When the variable speed drive 110 is properly connected to motor section 121, variable speed drive 110 causes pump 120 to pump oil from the producing portion of the well, through tubing string 150 to well head 151. The oil then flows out through production flow line 152 and into storage tanks (not shown in the figure.)

Figure 2:
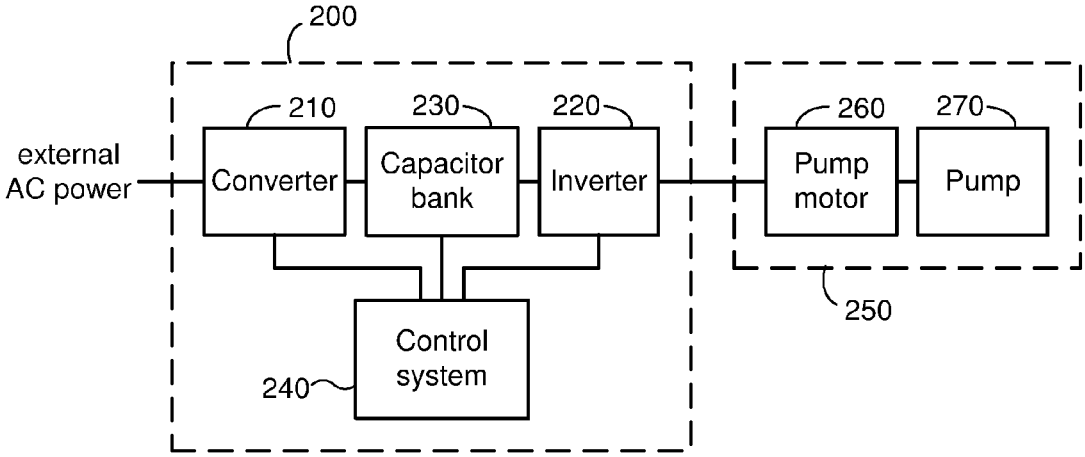
FIG. 2 is a functional block diagram illustrating the general structure of a system including a variable speed drive and pump in accordance with one embodiment.

Referring to FIG. 2, a functional block diagram illustrating the general structure of a system including a variable speed drive and pump in accordance with one embodiment is shown. Variable speed drive 200 includes a converter section 210 and an inverter section 220. The purpose of converter section 210 is to rectify the AC voltage received from the external power source. Converter section 210 generates DC power which is passed through an LC filter. The DC voltage generated by converter section 210 charges a capacitor bank 230 to a desired voltage. The desired voltage is achieved by controlling the operation of converter section 210. The voltage on capacitor bank 230 is then used to drive inverter section 220. The purpose of inverter section 220 is to generate a three-phase output voltage to drive an electric submersible pump system 250. The output signal may have various output waveforms, examples of which are described in more detail in U.S. Pat. No. 6,043,995. The output power produced by inverter section 220 may be filtered before being provided to the pump motor 260, which then drives pump 270.

Converter section 210 and inverter section 220 operate according to control signals received from a control module 240 of the variable speed drive. For example, the control module determines the timing with which the SCRs (silicon controlled rectifiers) of the converter section are turned on or "fired." This timing determines when, and for how long the external voltage on the input line is applied to capacitor bank 230, and thereby controls the voltage of the capacitor bank. If the SCRs are turned on as soon as the input line voltage goes positive, the SCRs will be switched on for the maximum amount of time, causing the capacitor bank voltage to move toward its maximum. If the switching on of the SCRs is delayed, they will be switched on for less than the maximum amount of time, and a lower capacitor bank voltage will be achieved. The control section of the variable speed drive similarly controls the operation of inverter section 220. The control section selects the desired output mode (e.g., standard PWM mode, six-step mode, or hybrid mode,) and adjusts the output voltage by varying appropriate factors. The converter section can also be comprised of diodes instead of SCRs. In this configuration, the voltage on the capacitors is at its maximum possible voltage at all times. The drive will always operate in PWM mode in this configuration.

Another function of control module 240 is to implement automated startup procedures to ensure that the pump is driven in the forward direction. Control module 240 controls the components of variable speed drive 200 and monitors various electrical characteristics of the components. Control module 240 then uses this information to determine the direction of rotation of the pump motor in relation to the phasing of the drive's output signal, and starts the pump in the forward direction.

Control module 240 may utilize a variety of methodologies to determine the rotation of the pump and the phasing required to drive the pump in the forward direction. The most appropriate methodology depends upon the particular characteristics of the overall system, such as whether or not a rotation sensor is installed on the pump, whether or not a check valve is installed to prevent backflow of fluid through the tubing string, and so on. Various combines using the different methodologies will be described below.

Figure 3:
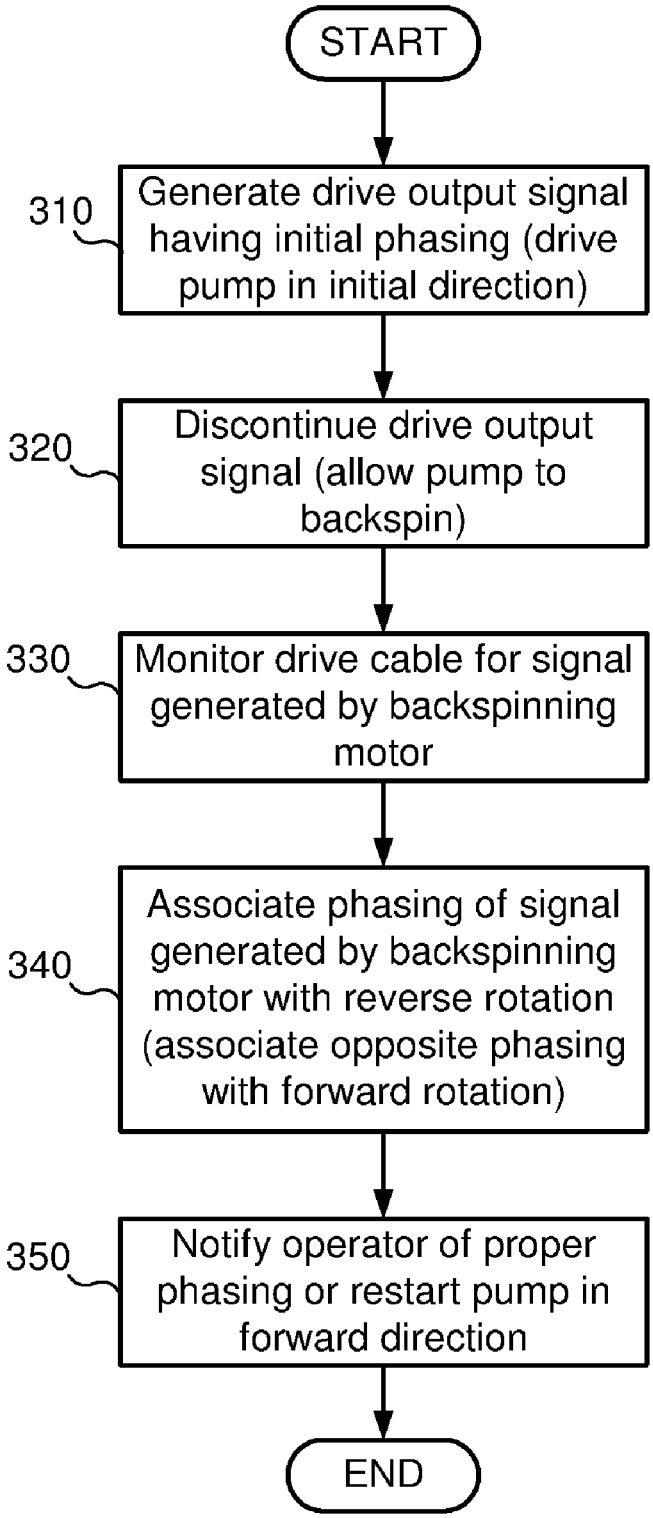
FIG. 3 is a flow diagram illustrating a method in accordance with one embodiment of the invention.

In one embodiment, the pump does not have a rotation sensor, and there is no check valve installed in the tubing string. The control module of the drive unit operates as illustrated in the flow diagram of FIG. 3. In this embodiment, the drive unit is configured to generate a drive signal having an initial phasing and to drive the pump with this signal (310). It does not matter whether the drive signal uses a forward or reverse phasing—as noted above, operating the pump in either direction will cause some fluid to be pumped into the tubing string. The drive unit continues to generate this drive signal for some period of time, creating a column of fluid in the string. It is not necessary to operate the pump long enough to produce fluid at the surface of the well because the purpose of this initial period of operation is simply to establish the column of fluid. It is contemplated that the drive unit will continue to drive the pump for some default period of time, such as one minute. At the end of this period, the drive unit will stop generating the output signal and driving the pump (320). The drive unit will instead monitor the drive cable that connects the drive unit to the pump.

When the drive unit stops in generating the drive output signal, the pump stops forcing fluid up through the tubing string. Gravity causes the column of fluid in the tubing string to drain back down through the tubing string and through the pump. As a result of the design of the pump, the falling column of fluid will always cause the pump to rotate in the reverse direction (i.e., backspin). As the pump backspins, it turns the motor section of the pump. The turning motor acts as a generator, producing a signal on the drive cable on which it normally receives the drive output signal from the drive unit. The signal produced by the motor is a three-phase signal which is similar to the three-phase signal generated by the drive unit (although it has a much smaller magnitude). Because the motor is spinning in the reverse direction, the signal generated by the motor will have reverse phasing (i.e., phasing which, if generated by the drive unit, would cause the motor and the pump to rotate in the reverse direction). The drive unit, which is monitoring the drive cable as the pump backspins, detects the signal generated by the pump motor and identifies the phasing of this signal (330). Because it is known that the falling column of fluid will always cause the motor to rotate in the reverse direction, it is known that the detected phasing is the reverse phasing (340). Since the drive unit now knows which phasing is the reverse phasing (the phasing that will drive the pump in the reverse direction) it also knows that the opposite phasing will drive the pump in the forward direction. The drive unit can then simply select the forward phasing and generate a drive output signal that drives the pump using this forward phasing, or it can notify the operator of the proper phasing (350).

Figure 4:
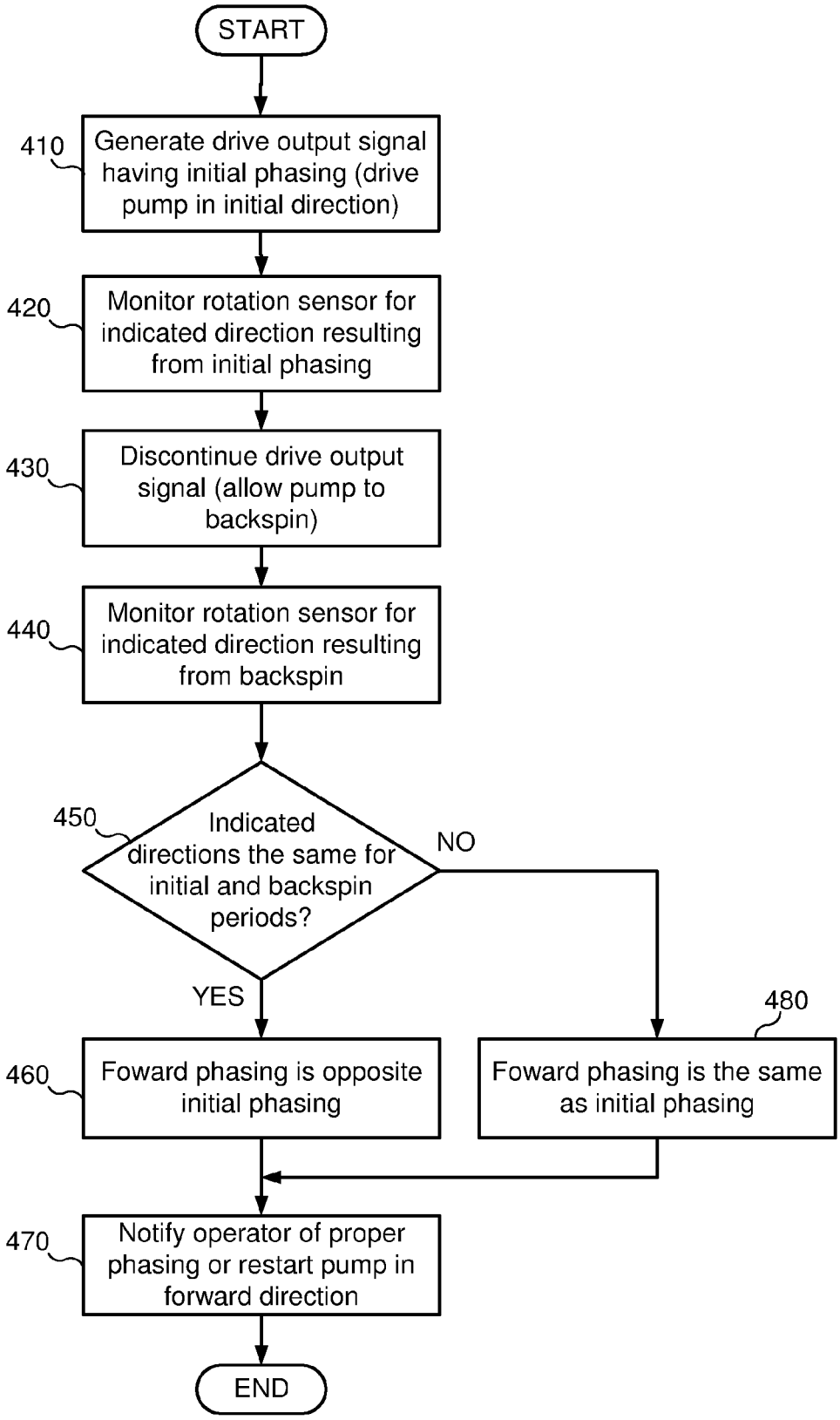
FIG. 4 is a flow diagram illustrating a method in accordance with an alternative embodiment of the invention.

In another embodiment, the pump system does not have a check valve installed in the tubing string, but there is a rotation sensor installed on the pump. It is assumed in this embodiment that the rotation sensor may be misconnected, so that the initial reading from the sensor (that the motor is turning in the forward or reverse direction) may be incorrect. In this embodiment, the drive unit's control module uses the methodology illustrated in the flow diagram of FIG. 4.

Similar to the previous embodiment, the drive initially generates an output signal using an initial phasing that may be either forward or reverse phasing (410). The drive continues to generate this output signal, which is conveyed to the pump motor through the drive cable, for a period that is sufficient to create a column of fluid in the tubing string. It is not necessary to produce fluid at the surface of the well, but only to establish the column of fluid. As the pump motor is driven during this initial period, the drive's control module monitors the rotation sensor which is coupled to the motor (420). Although it is not known whether the signal from the rotation sensor correctly indicates forward or reverse rotation of the motor, it is known that the indicated direction of rotation results from the initial phasing.

After the column of fluid has been established, the drive unit stops producing the drive output signal, so that the column of fluid may fall back down through the tubing string, causing the pump and motor to backspin (430). Rather than monitoring the drive cable to detect the phasing of the signal generated by the backspinning motor, the drive's control module again monitors the signal generated by the rotation sensor (440). Because it is known that the motor must be rotating in the reverse direction as the column of fluid is falling through the pump, the signal generated by the sensor is known to correspond to the reverse rotation of the motor. If the signal generated by the rotation sensor while the motor is backspinning indicates the same direction of rotation as that indicated during the initial period in which the pump was run by the drive unit, it is known that the initial phasing caused the pump to rotate in the reverse direction (450, 460). If the rotation sensor indicates different directions of rotation during the initial period of operation and the period of backspinning, then the initial phasing caused the pump to rotate in the forward direction (450, 480). The drive unit can then notify the operator or select the forward phasing and generate a drive output signal that uses this forward phasing (470).

Figure 5:
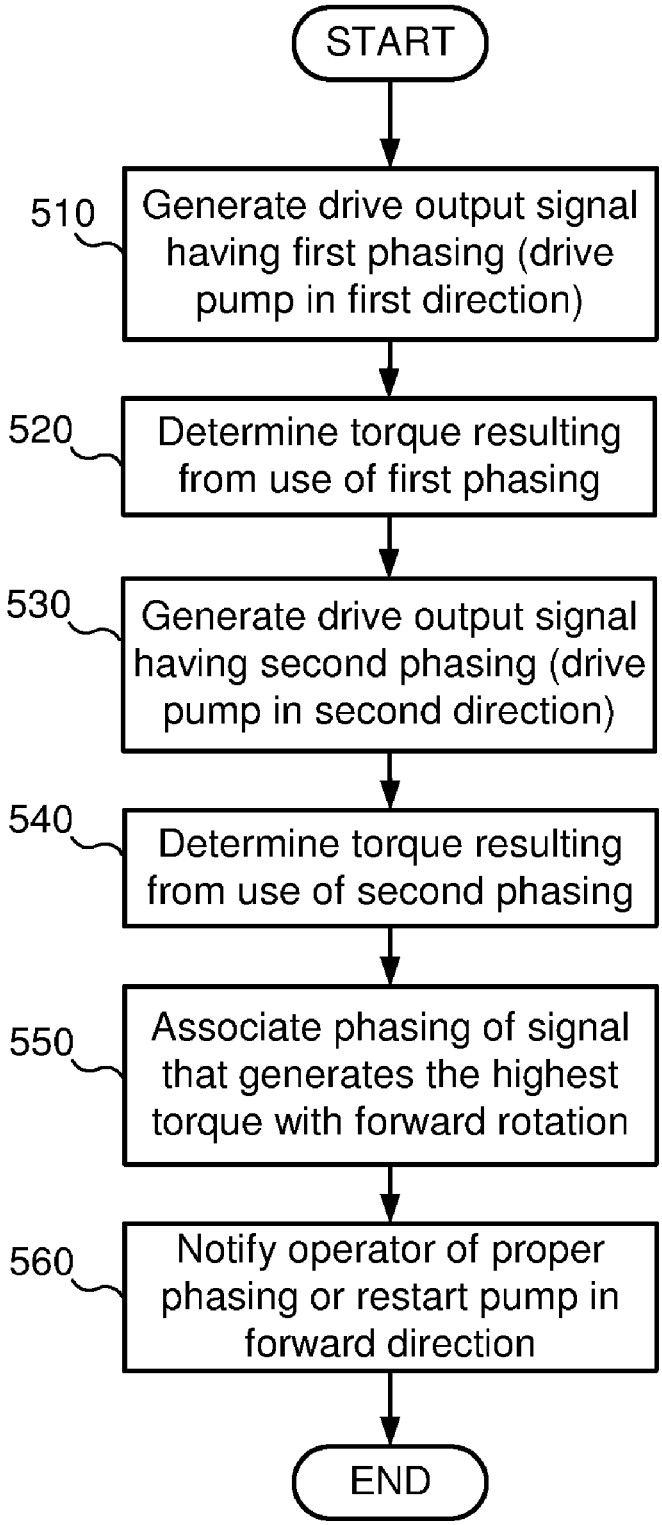
FIG. 5 is a flow diagram illustrating a method in accordance with another alternative embodiment of the invention.

In another embodiment, the pump system has a check valve installed in the tubing string. The check valve prevents the column of fluid in the tubing string from flowing back down through the pump and causing it to backspin. The control module of the drive unit in this embodiment implements the methodology illustrated in FIG. 5.

The drive unit selects a first phasing and generates a drive output signal using this phasing. The drive output signal is conveyed to the pump motor through the drive cable (510). As the drive unit is driving the pump using the first phasing, the control module monitors one more characteristics of the system. For instance, the control module may monitor the torque of the pump motor (520). Actually, the control module monitors the drive unit's output voltage and current, from which the control module can compute the power delivered to the pump motor. Higher power corresponds to higher torque, which in turn corresponds to a greater rate of flow of fluid that is being pumped through the tubing string. The drive unit does not have to drive the pump for long enough to produce fluid at the surface of the well, but only has to operate long enough to determine the torque generated by the motor.

After the torque of the motor using the first phasing is determined, the drive unit stops and allows the pump to stop rotating. Then, the drive unit selects a second phasing which is opposite the first phasing and generates a drive output signal using this second phasing (530). Again, the drive output signal drives the pump motor, which in turn drives the pump to pump fluid through the tubing string. The voltage and current of the drive output signal is again monitored by the control module to determine the torque that is generated by the pump motor (540). The pump only needs to be operated using the second phasing for a period long enough to determine the torque of the motor—it is not necessary to produce fluid at the surface of the well. After the control module has determined the torque developed by the motor using each phasing, these torques are compared to determine which phasing generates the higher torque. The phasing that generates the higher torque is assumed to be the forward phasing (550). The drive unit then notifies the operator or generates a drive output signal using the forward phasing and drives the pump using this output signal (560).

Figure 6:
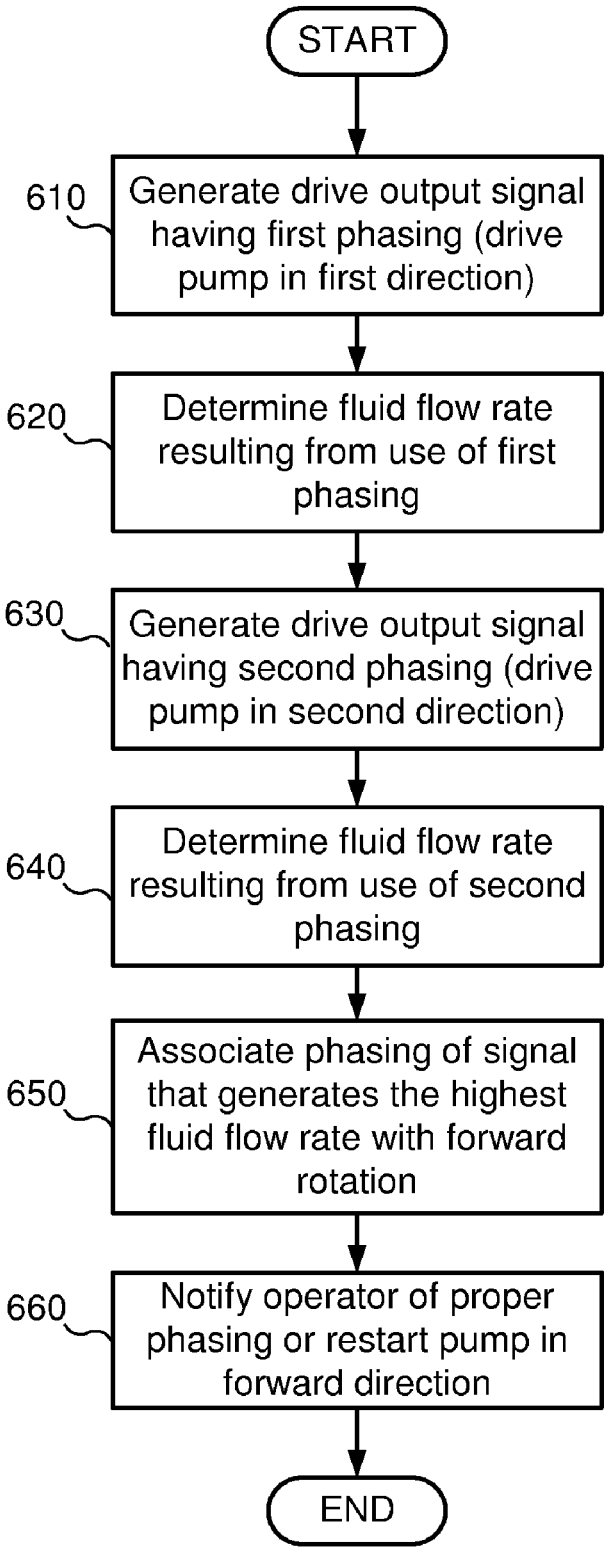
FIG. 6 is a flow diagram illustrating a method in accordance with another alternative embodiment of the invention.

In still another embodiment, the pumps system has a check valve installed in the tubing string. The system also has a flow meter that is installed either downhole, or at the surface of the well. In this embodiment, that control module of the drive implements the methodology illustrated in FIG. 6. The drive unit initially selects a first phasing and generates a drive output signal using the first phasing to drive the pump motor (610). As the pump is being driven using the first phasing, the flow meter is monitored to determine the rate of flow of fluid through the tubing string resulting from this phasing (620). After the flow rate corresponding to the first phasing is determined, the pump is allowed to stop, and the second phasing (which is opposite the first phasing) is selected by the control module. The drive unit then generates a drive output signal using the second phasing and drives the pump using this output signal (630). The flow meter is again monitored to determine the rate of flow of fluid resulting from the second phasing (640). The pump only needs to be operated for long enough using each phasing to determine the corresponding flow rate—it is not necessary to produce fluid at the surface of the well unless a surface flow meter is used. After the flow rate corresponding to each phasing is determined, the flow rates are compared. The phasing which generates the higher flow rate is assumed to be the forward phasing (650). The drive unit then notifies the operator or selects the forward phasing and generates a drive output signal to operate the pump in the forward direction (660).

Each of the above embodiments describes a method for identifying the phasing that results in forward rotation of the pump that is positioned in the well. These methods may substantially reduce the amount of time required to accurately identify the forward phasing and allow the pump to be operated most efficiently (i.e., in the forward direction). By reducing the amount of time that is required for this process, these embodiments reduce lost production, reduce the cost of field personnel on location at the well, reduce equipment wear, and thereby increase the efficiency of producing fluids from the well.

Each of the above embodiments also describes a drive unit that achieves the same benefits by automating the steps of the corresponding methods. Rather than requiring user intervention to manually perform each of the steps, the drive unit can select the appropriate phasing, monitor and measure the corresponding system characteristics, determine from these measurements which phasing drives the pump in the forward direction, and then begin normal operation to drive the pump in the forward direction. By automating these steps, the drive unit further reduces the amount of time required to accurately identify the proper phasing and begin forward operation of the pump, and eliminates the potential for operator error, again increasing the efficiency of fluid production from the well.

Because it typically will not be necessary to perform this procedure every time a pump is started, the drive unit may be configured to operate in several different modes. For example, the drive unit may have a first mode of operation in which the unit simply generates an output signal in the same manner as a conventional drive unit. In this "normal" operational mode, the drive unit would not perform the steps described above to determine the proper phasing for forward rotation of the pump, but would simply use what is believed to be the forward phasing. This phasing could be selectable by an operator, or could be selected based upon previous identification of forward phasing as described above. The drive unit could also have a second mode in which the unit performs the steps described above to determine the proper phasing for forward operation of the pump. An operator could select this second mode of operation when necessary (e.g., following installation or maintenance of the system during which incorrect connections between the drive unit and the pump could be made).

In another alternate embodiment, the drive unit could be configured to perform the steps necessary to determine forward phasing, without actually restarting the pump and the forward direction after the proper phasing is determined. In this embodiment, the drive unit may be configured to determine the phasing that produces forward rotation of the pump, and then provide notification of the proper phasing to the operator. This notification could, for example, be an identification of which phasing produces forward rotation of the pump, so that the operator could select the proper phasing, or it could be a simple notification that the existing connections between the drive unit and the pump motor are incorrect, so that the operator could manually change the connections to correct them.

In another alternate embodiment, the drive unit may be configured to implement more than one of the methodologies described above. For instance, the drive unit could be configured to first attempt one of the methods described above that involves pumping fluid into the tubing string and then allowing the column of fluid to fall through the pump, causing the pump to backspin. If no backspin is detected, this indicates that a check valve is present and is preventing the column of fluid from falling through the pump and causing the motor to backspin. In this case, the drive unit could perform one of the methods described above in which the pump is operated in both forward and reverse directions, and the corresponding torques, flow rates, or other characteristics are compared to determine which direction of rotation is the forward direction.

Those of skill will appreciate that the various illustrative logical blocks, modules, circuits, and algorithm steps described in connection with the embodiments disclosed herein may be implemented as electronic hardware, computer software (including firmware) or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Those of skill in the art may implement the described functionality in varying ways for each particular application, but such implementation decisions should not be interpreted as causing a departure from the scope of the present invention.

The control module described above may be implemented with application specific integrated circuits (ASICs), field programmable gate arrays (FPGAs), general purpose processors, digital signal processors (DSPs) or other logic devices, discrete gates or transistor logic, discrete hardware components, or any combination thereof designed to perform the functions described herein. A general purpose processor may be any conventional processor, controller, microcontroller, state machine or the like. A processor may also be implemented as a combination of computing devices, e.g., a combination of a DSP and a microprocessor, a plurality of microprocessors, one or more microprocessors in conjunction with a DSP core, or any other such configuration.

The steps of the methods described in connection with the embodiments disclosed herein may be embodied directly in hardware, in software (program instructions) executed by a processor, or in a combination of the two. Software may reside in RAM memory, flash memory, ROM memory, EPROM memory, EEPROM memory, registers, hard disk, a removable disk, a CD-ROM, or any other form of storage medium known in the art. Such a storage medium containing program instructions that embody one of the present methods is itself an alternative embodiment of the invention. One exemplary storage medium may be coupled to a processor, such that the processor can read information from, and write information to, the storage medium. In the alternative, the storage medium may be integral to the processor. The processor and the storage medium may reside, for example, in an ASIC.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein and recited within the following claims.

What is claimed is:

1. A method for automatically determining forward phasing for driving a downhole pump which is positioned in the borehole of a well, the method comprising:

generating an initial drive signal having an initial phasing and thereby driving the pump for an initial period of time which is sufficient to establish a column of fluid in the borehole, but which is insufficient to produce fluid at the surface out of the well;

discontinuing driving the pump and thereby allowing the column of fluid to fall through the pump and cause the pump to backspin in a reverse rotational direction;

determining a first phasing of a signal generated by rotation of the pump in the reverse rotational direction; and identifying a second phasing which is opposite the first phasing as a forward phasing which drives the pump in a forward rotational direction.

2. The method of claim 1, further comprising generating a drive output signal from a drive unit, wherein the drive output signal uses the second phasing, and driving the pump with the drive output signal.

3. The method of claim 1, further comprising providing a notification to an operator that the second phasing is the forward phasing which drives the pump in the forward rotational direction.

4. The method of claim 2, wherein a drive cable connected between the drive unit and the pump carries the drive output signal from the drive unit to the pump, and wherein determining the first phasing comprises monitoring a signal on the drive cable generated by the backspinning pump while the column of fluid falls through the pump, and identifying the phasing of the signal generated by the backspinning pump as the first phasing.

5. The method of claim 1, wherein determining the first phasing comprises monitoring a rotation sensor which is coupled to the pump during the initial period of time and while the pump is backspinning, determining based on the monitoring of the rotation sensor whether the pump rotates in the same direction or in different directions during the initial period of time and while the pump is backspinning, identifying the initial phasing as the first phasing in response to determining that the pump rotates in the same direction during the initial period of time and while the pump is backspinning, and identifying first phasing as the opposite of the initial phasing in response to determining that the pump rotates in different directions during the initial period of time and while the pump is backspinning.

6. The method of claim 1, wherein the initial period of time comprises a predetermined default period, and wherein driving the pump is discontinued after the default period has elapsed.

7. A system comprising:

a drive unit configured to drive a downhole pump;

wherein the drive unit includes a control module that controls operation of the drive unit;

wherein in a first mode of operation, the control module causes the drive unit to generate an initial drive signal having an initial phasing for an initial period of time, discontinue driving the pump and thereby allowing a column of fluid to fall through the pump and cause the pump to backspin in a reverse rotational direction, determine a first phasing of a signal generated by rotation of the pump in the reverse rotational direction, and identify a second phasing which is opposite the first phasing as a forward phasing which drives the pump in a forward rotational direction.

8. The system of claim 7, wherein the drive unit is configured to generate a drive output signal that has the second phasing.

9. The system of claim 7, wherein the drive unit is configured to provide a notification to an operator that the second phasing is the forward phasing which drives the pump in the forward rotational direction.

10. The system of claim 7, further comprising the downhole pump and a drive cable connected between the drive unit and the pump, wherein the drive cable carries a drive output signal from the drive unit to the pump, wherein the drive unit is configured to determine the first phasing by monitoring a signal on the drive cable generated by the backspinning pump while the column of fluid falls through the pump, and identifying the phasing of the signal generated by the backspinning pump as the first phasing.

11. The system of claim 7, further comprising the downhole pump and a rotation sensor coupled to the pump and configured to sense rotation of the pump, wherein the drive unit is configured to determine the first phasing by monitoring the rotation sensor during the initial period of time and while the pump is backspinning, determine based on the monitoring of the rotation sensor whether the pump rotates in the same direction or in different directions during the initial period of time and while the pump is backspinning, identify the initial phasing as the first phasing in response to determining that the pump rotates in the same direction during the initial period of time and while the pump is backspinning, and identify first phasing as the opposite of the initial phasing in response to determining that the pump rotates in different directions during the initial period of time and while the pump is backspinning.

12. The system of claim 7, wherein the drive unit is operable in either the first mode of operation or in a second mode of operation, wherein in the second mode of operation, the control module causes the drive unit to generate a drive output signal without first determining whether the first phasing or the second phasing is associated with the forward rotational direction of the pump.

13. The system of claim 7, further comprising the downhole pump and a drive cable coupled between the drive unit and the downhole pump, wherein the drive cable is configured to carry a drive output signal from the drive unit to the downhole pump.

14. The system of claim 7, wherein the initial period of time comprises a predetermined default period, and wherein the control module causes the drive unit to generate the initial drive signal for the default period and then discontinue driving the pump.

* * * * *